US005527564A

United States Patent [19]

Napadow et al.

[11] Patent Number: 5,527,564

[45] Date of Patent: Jun. 18, 1996

[54] METHOD AND APPARATUS FOR REPELLING OVERSPRAY IN SPRAY PAINT BOOTHS

[75] Inventors: Stanley C. Napadow, 211 Brookside Dr., Elgin, Ill. 60123; Robert G. Smead, St. Charles; Gary L. Demeny, Delavan, both of Ill.

[73] Assignee: Stanley C. Napadow, Elgin, Ill.

[21] Appl. No.: 495,334

[22] Filed: Mar. 19, 1990

[51] Int. Cl.[6] ..... B05D 1/04; B05B 5/025; B05B 5/04; B05B 5/10

[52] U.S. Cl. ..... 427/477; 427/483; 118/629; 118/630; 118/634

[58] Field of Search ..... 118/629, 634, 118/DIG. 7, 630; 427/27, 477, 483; 98/115.2; 55/DIG. 46; 454/50

[56] References Cited

U.S. PATENT DOCUMENTS 3,801,869 4/1974 Masuda ..... 98/115.2 X
5,169,673 12/1992 Demeny et al. ..... 118/634

FOREIGN PATENT DOCUMENTS 205557 8/1956 Australia ..... 427/27
213625 10/1956 Australia ..... 427/27

*Primary Examiner*—Diana Dudash
*Attorney, Agent, or Firm*—Fitch, Even, Tabin & Flannery

[57] ABSTRACT

A method of electrostatically painting and an apparatus for producing an electric field within a booth includes a paint spray gun charged to a first potential and a target to be painted to a second potential with one of the panels in the booth charged to a third potential intermediate the first potential and the second potential to repel paint particles away from the panel. The paint particles and the panels are charged to the same polarity and the target is of the opposite polarity. The panel is usually a wall, a ceiling and/or a conveyor protection housing within the paint spray booth. The preferred panel comprises an outer insulating layer of plastic, glass or porcelain that is easily wiped of paint and an interior, electrically-conducting layer such as a thin sheet of aluminum. Variations of the panel include a version which is completely enclosed in plastic and a version which is bonded to plastic.

22 Claims, 3 Drawing Sheets

METHOD AND APPARATUS FOR REPELLING OVERSPRAY IN SPRAY PAINT BOOTHS

This invention relates to panels used in booths and, more particularly, to panels used within or about booths having electrically charged, airborne coating particles entrained in air.

BACKGROUND OF THE INVENTION

An electrostatic paint system consists of a paint booth or enclosure in which a coating such as paint is applied to parts, a conveyor for carrying parts into and out of the booth and an electrostatic paint applying system. The paint applying system includes an atomizing device which receives a fluid column of paint and atomizes it into finely divided paint particles, places an electrical charge on the particles, creates an electrical field between the device and ground, imparts a velocity to the paint particles which directs them toward the grounded part to be coated and meters the paint. Electrically charged paint particles are attracted to and have an affinity for the grounded object to be painted since the grounded object assumes a polarity opposite that of the atomizing device. The charged particle, acted upon by the electrical field, can be deflected from its original trajectory in the direction of the grounded object.

In an automatic electrostatic system, the atomizing device may be mounted in a fixed position, attached to a gun mover device that provides reciprocating motion, attached to a robot that imparts a predetermined complex motion or manipulated manually. An electrostatic atomizer greatly increases paint transfer efficiency from the gun to the surface to be coated as compared to a non-electrostatic device. Electrostatic systems apply paint at transfer efficiencies in the 50%–80% range. Transfer efficiency rarely approaches 100%.

The atomized paint that is not applied to the part is generally referred to as overspray. Overspray consists of paint that misses the part due to rebound from the part surface and paint particles electrostatically deflected to other grounded surfaces such as the spray booth metal components and article conveyors. Most overspray is entrained in the spray booth exhaust air. A significant amount is deposited on the spray booth ceiling, conveyor protection and conveyor. Paint accumulating on these surfaces causes rejects when it drops off on freshly painted parts. This results in downtime for cleaning purposes. This invention relates to a means of greatly reducing paint accumulation on these surfaces.

SUMMARY OF THE INVENTION

Among its several aspects and features, the present invention provides an electrically charged panel which repels electrically charged dry or wet coating particles inside an electrostatic spray painting booth, or other booths having charged paint or powder particles therein. The booths include an electrostatic paint sprayer which is charged to a potential of 60,000 to 135,000 volts D.C. negative with respect to ground. It produces a spray of dry or wet paint particles which is negatively charged. An object or article to be painted is at ground potential. The system comprises one or more panels or walls which are charged to a potential between the typical −100,000 volt D.C. potential with respect to ground to which a spray gun is charged and the ground potential of the target to be painted. In a preferred embodiment of the invention, the panels are charged to a potential of 30,000 volts D.C. negative with respect to ground by a power supply with current limitation. The resulting electrostatic field emanating from the panels repels the oversprayed paint particles and reduces the accumulation of paint on surfaces near the target. It may be appreciated that the panels or walls are charged to a voltage of the same sign as the electrically charged particles. The present invention provides a system for repelling negatively charged particles which overspray their intended target.

By reducing the accumulation of oversprayed paint on surfaces near the target, the present invention reduces the frequency with which dripping or flaking paint falls on a target during the painting process and ruins the paint job. Also, paint repelled by the charged panels is redirected back toward the target to be attracted to the same. In this way, the present invention increases the efficiency of the use of paint by reducing the amount of paint wasted on surfaces other than the target and on scrapped paint jobs. By reducing the frequency of ruined paint jobs, the present invention also increases the efficiency of the use of a painting booth by reducing the amount of time when the booth is out of service for cleaning.

Among its several aspects and features, the present invention also provides the aforementioned electrically charged panel which includes a conductor sheet completely enclosed in a dielectric such as plastic. The electrical field created by the charged conductor panel is not impeded by the insulation of the plastic. Used to line surfaces inside an electrostatic spray painting booth and charged to a voltage of the same sign as the electrically charged paint, the present invention repels oversprayed paint as described above, which allows painting closer to a conveyor protector or a booth ceiling. Shorter article hangers can be used and longer or larger articles to be painted can be run in the same booth. Also, the present invention reduces the capital expenditure required to build a new painting booth and other process equipment by decreasing the size of the system necessary for painting targets of a particular maximum size. The plastic surface of the panels also makes it easier to clean paint from the panels than from a surface other than plastic. Being easier to clean than other surfaces, the present invention decreases the amount of labor necessary to clean accumulated overspray from the surfaces of a painting booth. This reduction of labor increases the efficiency of the painting booth by decreasing the time when it is out of service for cleaning.

Briefly, the paint repelling device of the present invention includes an electrically conducting sheet having a planar surface. The device also includes an electric power source capable of placing an electric potential on the surface of the electrically conducting sheet. The device further includes means for connecting the electric power source to the electrically conducting sheet such that there is generated a repelling field of electric potential of the same sign as and of sufficient strength to repel the electrically charged paint. In the preferred embodiment, the electrically conducting plate is composed of aluminum laminated in plastic.

BRIEF DESCRIPTION OF THE DRAWINGS

Referring now to the drawings.

DETAILED DESCRIPTION OF THE PREFERRED EMBODIMENT

Figure 1:
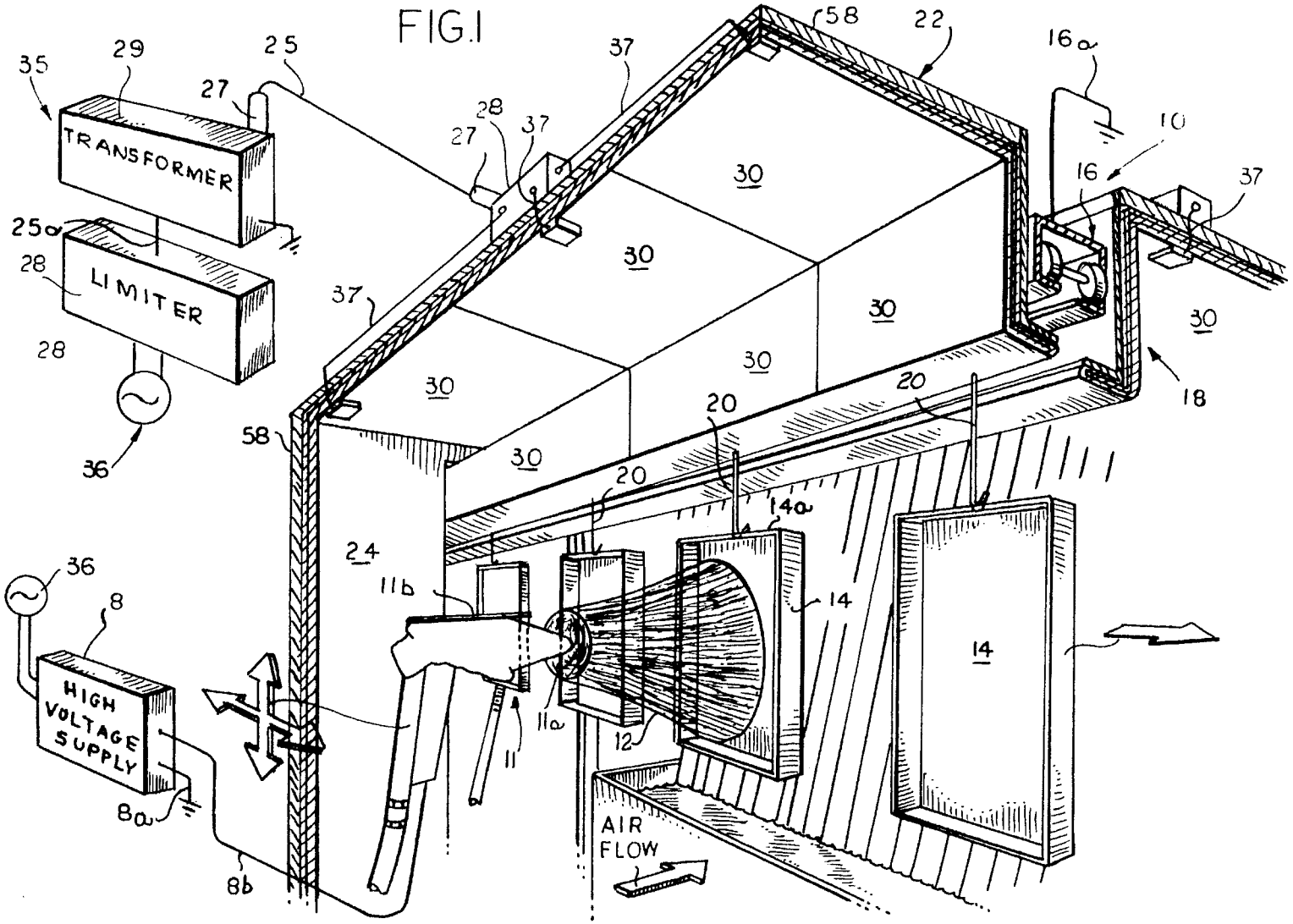
FIG. 1 is a diagrammatic view of a painting booth containing electrostatic spray painting apparatus and constructed in accordance with the invention.

As shown in the drawings for the purposes of illustration, the invention is embodied in a booth 10 having an electrostatic paint spraying, paint applying or spray gun apparatus 11 for generating a paint spray 12 comprising a plurality of paint particles or paint droplets. The electrostatic paint applying apparatus 11 is charged to −100,000 volts D.C. by a high voltage power supply 8 having a grounded lead **8*a* and a lead 8*b* connected to the electrostatic paint applying apparatus 11. The power supply 8 and lead 8*b* comprise means for charging the spray gun apparatus to a first potential. The paint spray 12 is electrostatically attracted to an object, article or target 14 to be painted, having a top edge 14*a*. Herein, the object 14 is conveyed through the booth 10 by an overhead conveyor 16 which is enclosed by a conveyor protection housing 18 in which is pressurized air, as disclosed in U.S. Pat. Nos. 3,749,229 and 4,207,833. The objects 14 to be spray painted are suspended on electrically conductive hangers 20. Typically, the overhead conveyor 16, the ceiling 22 and the walls 24 are grounded. The target 14 is grounded, as are the ceiling 22 and the side walls 24 of the booth 10. Thus an electrostatic field is established by the polarity and potential difference between the electrostatic paint applying apparatus 11 on the one hand and the target 14, and the other grounded members of the booth 10. The paint particles of the paint spray 12 are electrically charged, usually with a negative charge, and the grounded target 14** attracts the charged paint particles.

Prior to this invention, some of the paint particles 12 were not conveyed to the target 14 and became overspray particles that were electrostatically attracted to the grounded ceiling 22 or to the grounded conveyor protection housing 18. When paint adhered to the conveyer housing 18 or the ceiling 22 and did not dry, it tended to drip from those overhead structures. Other types of paint adhering to the conveyor housing 18 and the ceiling 22 tended to dry after which they would flake or chip off. The loose flakes would fall and adhere to the freshly painted surface on the target 14, causing a paint defect. Manifestly, the paint that is collected on the booth surfaces rather than on the object to be painted is wasted and the paint accumulated on the booth surfaces must be removed. This is a costly maintenance problem and the downtime of a spray booth for such maintenance detracts from the production efficiency for the booth 10.

In accordance with the present invention, the electrostatic paint spray particles 12 that coat the conveyer protection housing 18, the ceilings 22 and/or the walls 24 in the spray booth 10 are substantially reduced from collecting on such walls or ceilings, allowing more of the paint spray generated to be deposited on the articles 14 being painted. This is achieved by providing a plurality of panels or walls 30, each having large conductor sheets or surfaces 32, which may be aluminum sheet or foil, electrically charged to create a repelling field of the same polarity to that of the charged paint particles. The large sheet panels 30 may be positioned at areas which typically become coated with paint in a booth. The panels 30 are charged to −30,000 D.C. volts with respect to ground, which then generates a large repelling field of the same polarity as the paint particles. Typically, such charged panels may be used on the ceilings above the articles, on the exposed sides of the conveyor housing, sidewalls of the booth, or floors of the booth. Better painting efficiency is achieved because the repelled paint particles 12 will become available to adhere to the articles 14 being painted. The amount of downtime used for cleaning the booth 10 is reduced very substantially. With less paint applied to the booth ceilings 22 and the conveyor protection housings 18, there is less likelihood that overspray will accumulate and drip or flake off onto an article 14 being painted and cause a defect in the paint coating.

In the preferred embodiment of the invention, the electrically conductive sheets 32 of the panels 30 are protected or covered by a dielectric comprising an outer plastic layer 19 that prevents any exposure of the charged conductor to atmosphere or physical contact. New booth construction having the plastic covered, repelling panels may be made smaller, particularly in height, thereby reducing very substantially the cost of the booth. As will be explained in connection with FIG. 5, alternatively, panels or walls having thin aluminum sheets **32*a* which are not embedded in plastic and mounted on insulator, standoffs may be charged to a −30,000 volt D.C. potential and generate the paint repelling field. The outer dielectric layer 19** may be made of glass or porcelain rather than plastic.

Turning now to a more detailed description of the invention, the booth 10 is provided with the paint repelling panels 30 at the locations where the paint particles 12 are most likely to accumulate on the booth walls 24 and/or on the overhead conveyor protection housing 18, which is immediately above the article 14 being painted. Typically, the spray gun apparatus 11 is moved vertically or horizontally by automatic equipment, which is not shown, to an upper position close to the conveyor protection housing 18 at the top of the upward stroke of the spray gun 11.

The electrostatic paint applying apparatus 11 may be a commercially available device. In Tables I and II, the results of varying the pressure of the pattern air on a rotary atomizer from 10 psig to 30 psig to impart different velocities to the paint particles 12 are set forth. A spinning disk **11*a*** is driven by an air-driven turbine and the turbine air pressure is variable, e.g., from 50 psig in Table I to 30 psig in Table II. Various types of electrostatic spray guns may be employed as well.

FIG. 1 generally shows the painting booth 10 having the paint repelling panels 30 attached to surfaces in the upper portion of the painting booth 10, including the exterior of surfaces of the conveyer protection housing 18, the ceiling 22 of painting booth 10 and the walls 24 of painting booth 10. The panels 30 are electrically connected by means of a plurality of electrical leads 25 (shown schematically) each extending from a panel to a common splitter box 28 which is connected by a cable 25, which is within a protective duct or conduit 27 partially broken away, which extends to a transformer 29, which comprises means for charging the panels 30 to a potential of −30,000 volts D.C. with respect to ground. The potential on the panels 30 is of the same sign as the charge on the electrically charged paint 12. The transformer 29 is connected by electrical conductors **25*a* to a limiter 28 (shown schematically) which limits the current level to the panels 30**. A person skilled in the art can adapt the shape of these panels to line surfaces of diverse geometrical descriptions, whether flat, curved, bent at an angle or some combination thereof, as necessary to repel electrically charged paint.

Figure 2:
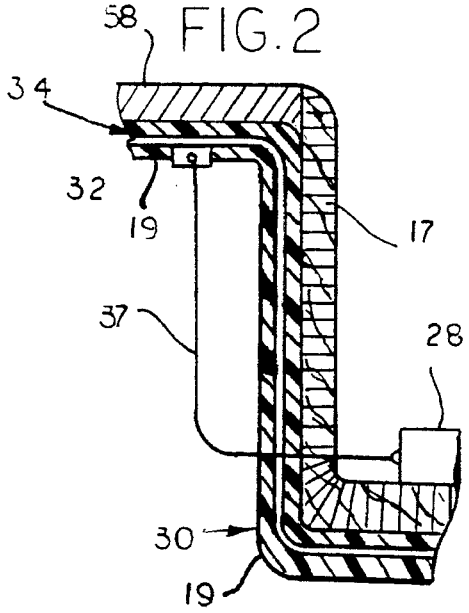
FIGS. 2 and 3 are sectional, fragmentary views showing a paint repelling panel having a dielectric such as plastic useful as a conveyor protection device.

FIG. 2 is a cross sectional view of the paint repelling panel 30 which shows that the paint repelling panel 30 comprises an aluminum sheet 32 sandwiched between two sheets of polypropylene 19 and 34. Aluminum sheet 32 is connected by means of electrical conductors 25 and 37 of FIG. 1 (shown schematically) to the transformer. Polypropylene surface 34 of panel 30 is contiguous with a wall within painting booth 10. The opposite polypropylene surface 19 of panel 30 faces away from surface 17 to which panel 30 is attached. By means of electric conductors 25 and 37, transformer 29 places an electric potential on aluminum sheet 32 such that the voltage on sheet 30 has the same sign as electrically charged paint to be repelled.

The paint repelling panel 30 operates as follows: Assuming that spray gun apparatus 11 is charged to a potential of −100,000 volts D.C. with respect to ground at its nozzle 11*a*, that the spray apparatus 11 is spaced from the articles and that hook 20 of overhead conveyor 16 is one foot long, then transformer 29 charges the aluminum sheets 32 of the panels to −30,000 volts D.C. with respect to ground and the spray gun 11 can operate at any height at least one foot from grounded surfaces such as articles 14.

Figure 3A:
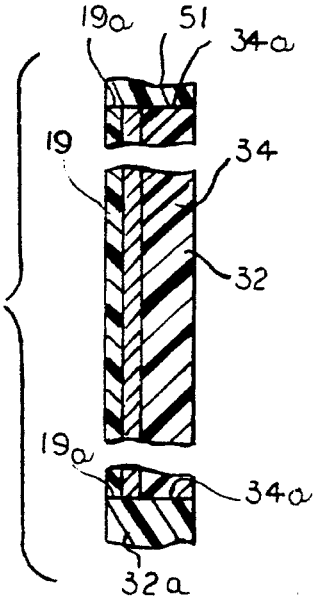
FIG. 3A is a cross sectional view of a paint repelling panel having a conductor laminated in plastic.
Figure 3:
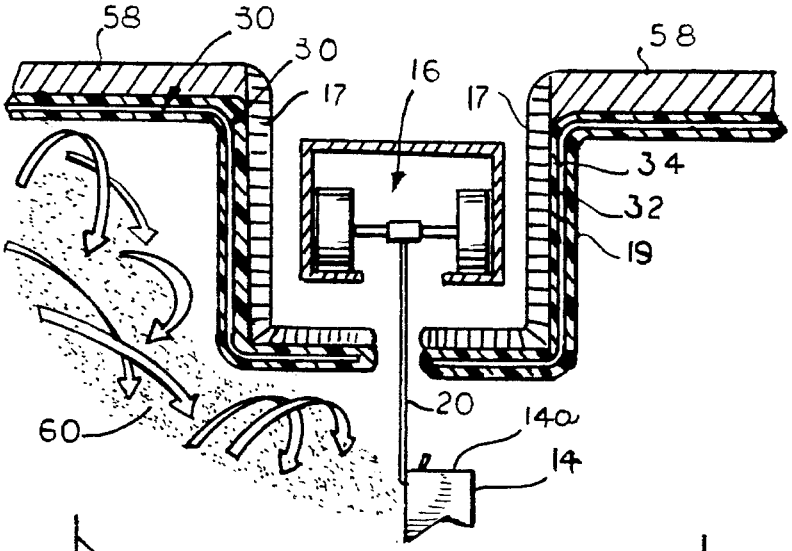

The spray gun apparatus 11 sprays negatively charged paint droplets 12 at target 14. Some negatively charged paint droplets miss target and approach the panels 30. FIG. 3 generally depicts a cross sectional view of panels 30 against ceiling 22 and conveyor housing 17 repelling stray paint 60. Charged to −30,000 volts D.C. on aluminum sheet 32, panels 30 produce an electric field which repels negative charges and therefore repels negatively charged stray paint 60 which misses target 14. Repelled, paint particles 60 fall. Some of the falling, repelled, stray paint particles 60 adheres to target 14, and other portions of it may be carried off to the air filters, not shown.

Figure 4:
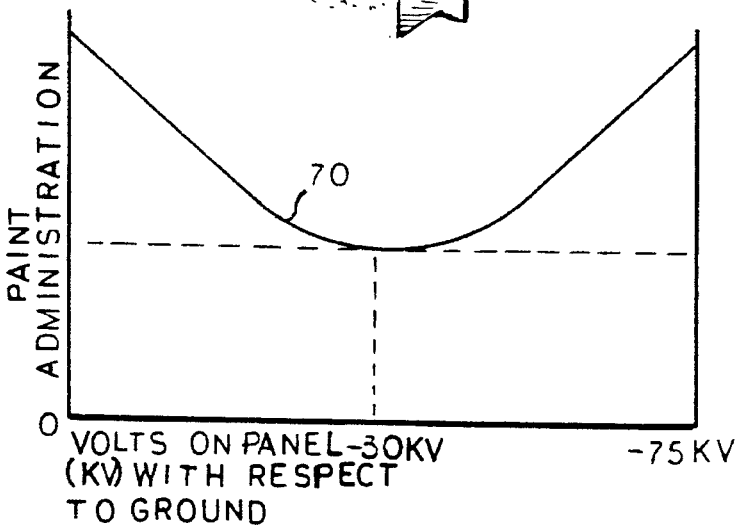
FIG. 4 is a graph showing accumulation of oversprayed paint on a paint repelling panel as a function of voltage, with respect to ground, on the panel.

As best seen in FIG. 1, an electrical power means 35 is provided preferably in the form of the electric transformer 29, having a rectifier for direct current output, which is connected to an A.C. power source 36 and is capable of generating the desired voltage which is preferably about −30,000 volts D.C., as shown in FIG. 4, and for the reasons given hereinafter. The voltage may be varied to suit the individual needs of the system. The current is kept very low, e.g., in a range of 10 to 50 microamperes. It is preferred to provide the transformer with a limiter 28 which detects a current rise and shuts off the transformer before an arc can occur. The limiter may be set at 10 microamperes above operating current draw, for instance, so that when the current begins to rise to signify incipient arcing the transformer may be shut off and the voltage extinguished on the panels 30.

The electrical power means 35 also includes the electrical conductor means 25 which is preferably in the form of an electrical cable carried in the duct 27 or other protected area so that it will not be damaged. The conductor means also includes an electrical lead 37 from each separate panel to the cable, and the cable extends from the transformer and a control panel (not shown) through the booth to each of the panels. Because the transformer has a high power generation, it may be coupled to a plurality of adjacent booths.

The panels 30 for the walls and ceiling may be large panels e.g., four feet by eight feet or three feet by six feet. In the panel 30 shown in FIG. 3A, the interior metal sheet 32 of aluminum which may be as thin as an aluminum foil is sandwiched between a paint repelling outer plastic layer 19 and an inner plastic layer 34. The preferred plastic layer material is polypropylene which can be easily cleaned of paint. At edges 19*a* and 34*a* of the sheets, a weld 51 of polypropylene provides a thick bead to encase the edges 32*a* of the metal sheet 32. Thus, the metal sheet 34 is surrounded on all sides and edges by plastic. If desired, the metal sheet could have plastic molded about it to completely embed the sheet without welding. Extending the edges of the plastic panel to double the arcing distance of the 30,000 volts D.C. will also effectively isolate the metal conductor from ground. Herein, the plastic layer 19 facing the paint is only about 1/16 inch thick and the protectoral plastic layer 34 against the metal housing wall 58 is about ¼ inch thick.

Figure 5:
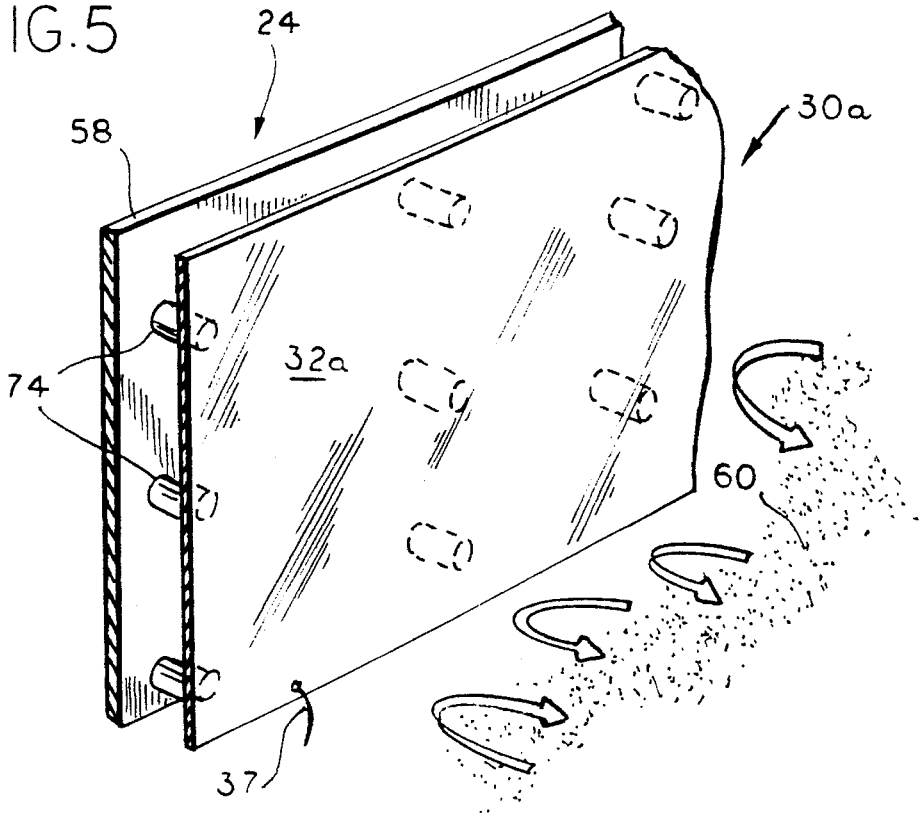
FIG. 5 is an isometric view of a metal plate having a charge which creates an electric field to repel paint particles.

In the embodiment shown in FIG. 5, thin metal foil sheet panels 30*a* are mounted by insulator standoffs 74 on the metal sheet wall 58 of the booth or on the metal wall of the protective conveyor device. An electrical lead 37 is connected to the metal panel 30*a* to provide the voltage potential desired, e.g., −30,000 volts D.C. at the panel 30*a*. The standoffs isolate electrically the metal booth wall 58, which will be grounded, from the −30,000 volts D.C. at the panel.

Figure 6:
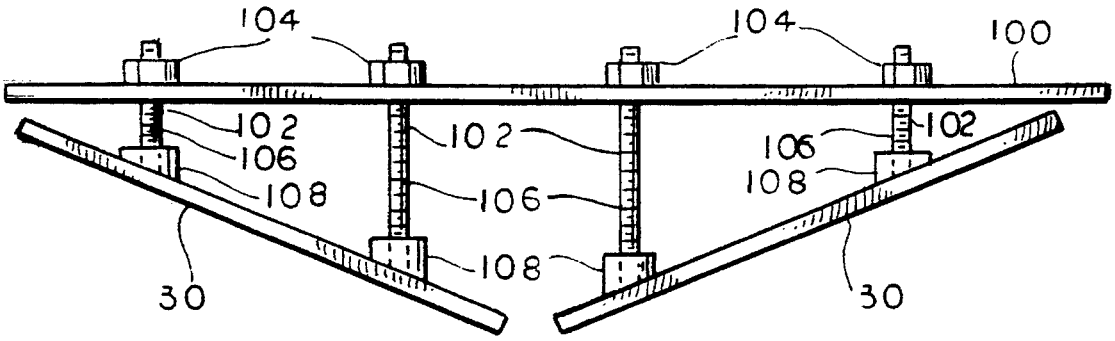
FIG. 6 is a side elevational view of a pair of panels embodying the instant invention suspended from a plurality of insulating stringers.

As may best be seen in FIG. 6, the panels 30 also may be suspended from a structure 100, which may be a booth 10 or other adjacent the booth 10, by a plurality of threaded, metal rod-type hangars 102. Each of the stringers 102 comprises a nut or threaded block 104 which engages the structure 100. An elongated threaded metal rod 106 threadedly engages the nut or block 104. The elongated rods 106 extend to the panels 30 and are threadedly connected to polypropylene blocks 108 welded to the panels, which also engage and support the panels 30. It may be appreciated that the stringers 102 allow the panels 30 to be positioned at a variety of distances from the structure 100 and in a variety of orientations with respect to it, thereby providing the booth operator with ability to tailor the electrostatic paint repelling effects of the panels to many different booths.

The panels need not be solid panels of metal as above-described but also may be made of metal mesh. Alternately, a good electrical conductive material other than metal could be used in or with the panels 30 or 30*a* such as conductive coatings or salts.

The following experiments demonstrate the effectiveness of the present invention at protecting ceilings and conveyors in an electrostatic paint spraying booth by repelling electrically charged paint particles:

Experiment I: Ceiling Protection Test

This experiment compared the amount of stray paint which accumulated on a grounded foil panel 30*a* above the rotary atomizer to the amount of paint which accumulated on a sheet of aluminum 30*a* in the same location charged to voltages of −20 and −30 kilovolts D.C. The data shows that less paint accumulated on the charged aluminum panel than on the grounded foil panel.

For each set of conditions, a baseline was established by setting the positions of a sheet metal part (target) 14 and the atomizer 14 with respect to the ceiling 22 of the painting booth, attaching a weighed, foil sheet 30*a* to the plastic isolating panel, grounding the foil sheet and painting the target for 60 seconds. The foil sheet 30*a* was then removed from the plastic panel, dried and weighed. The amount of accumulated, stray paint was calculated by subtracting the weight of the panel before painting from its dry weight after painting. New, weighed foil sheets 30*a* were used for each test.

After establishing the baseline, aluminum panels were substituted for the foil panels, run at −20 and −30 kilovolts D.C. negative and isolated from ground. Tests were run with the rotary atomizer at 12, 18 and 24 inches from the ceiling panel. (The vertical position of the target was also varied for some tests.) Each set of panels was dried and weighed, and the percent reduction in paint deposited compared to the grounded panel was calculated. Table I shows the results:

TABLE I

| ATOMIZER TO CEILING | PATTERN AIR | VOLTAGE ON FOIL | TURBINE AIR | WT. GAIN ON PANEL | % REDUCTION |
|---|---|---|---|---|---|
| 18" | 20 psig | Ground | 30 psig | 16.76 | — |
| 18" | 20 psig | −30 KV | 30 psig | 4.39 | 74% |
| 24" | 20 psig | Ground | 50 psig | 4.38 | — |
| 24" | 20 psig | −30 KV | 50 psig | 0.09 | 98% |
| 18" | 30 psig | Ground | 50 psig | 13.85 | — |
| 18" | 30 psig | −30 KV | 50 psig | 1.55 | 89% |
| 18" | 20 psig | Ground | 50 psig | 18.93 | — |
| 18" | 20 psig | −30 KV | 50 psig | 5.36 | 72% |
| 18" | 30 psig | Ground | 50 psig | 13.85 | |
| 18" | 30 psig | −30 KV | 50 psig | 7.32 | 47% |
| 18" | 30 psig | Isolated | 50 psig | 5.94 | 57% |
| 24" | 30 psig | Ground | 50 psig | 4.22 | |
| 24" | 30 psig | −30 KV | 50 psig | 0.05 | 98.8% |

In Table I, where the foil was at "Ground" without any repelling charge, the paint weight gain on the panel was much greater than when 20 or 30 KV D.C. was applied to the foil to cause it to repel paint particles. This difference in weight gain is reflected as the "% Reduction" which range from 74% to 98% in these tests.

Experiment II: Conveyor Protection Test

This experiment compared the amount of paint which accumulated on a grounded foil sheet which was placed around the conveyor housing to the percent of paint which accumulated on an aluminum panel in the same location charged to −30,000 volts D.C.

Table II shows the results:

TABLE II

| ATOMIZER & PROTECTOR | TURBINE V | PATTERN AIR-PSI | VOLTAGE FOIL | TURBINE AIR | WT. GAIN ON PANEL | % REDUC-TION |
|---|---|---|---|---|---|---|
| 18" | −85 KV | 10 | Ground | 30 | 0.30* | — |
| 12" | −85 KV | 10 | Ground | 30 | 12.85 | |
| 12" | −85 KV | 10 | −30 KV | 30 | 0.52 | 96% |
| 12" | −85 KV | 10 | Ground | 50 | 15.83 | |
| 12" | −85 KV | 10 | −30 KV | 50 | 1.58 | 90% |
| 12" | −115 KV | 30 | Ground | 50 | 19.80 | |
| 12" | −115 KV | 30 | −30 KV | 50 | 0.35 | 98% |
| 18" | −115 KV | 30 | Ground | 50 | 9.91 | |
| 18" | −115 KV | 30 | −30 KV | 50 | 0.07 | 99+% |

*SINCE WEIGHT GAIN WAS SMALL, DISCONTINUED TEST AT THIS DISTANCE AND VOLTAGE

Table II demonstrates that a 90% to 99% reduction in paint accumulation on the conveyor housing 18 may be achieved by having protective, repelling panels 30 added to the conveyor housing 18.

Experiment III: Ceiling Protection Test

This experiment compared the amount of stray paint which accumulated on a grounded foil sheet 30*a* which was placed on the booth ceiling to the amount of stray paint which accumulated on an aluminum panel in the same location charged to −30,000 volts D.C. The data shows that considerably less paint accumulated on the charged aluminum panel than on the grounded foil panel.

For each set of test conditions, a baseline was established by setting the positions of a sheet metal part (target) and the atomizer (spray gun) with respect to the ceiling conveyor housing, attaching a weighed, foil sheet to the plastic protector (around the ceiling conveyor housing), grounding the foil sheet and painting the target for 60 seconds. The foil sheet was then removed from the plastic protector, dried and weighed. The amount of accumulated, stray paint was calculated by subtracting the weight of the panel before painting from its dry weight after painting. New, weighed foil sheets were used for each test.

After the baseline had been established, aluminum panels were charged to −30,000 volts D.C. with respect to ground with the spray gun centerline at 3, 6 and 9 inches from the plastic protector around the conveyor housing. Table III shows the results:

TABLE III

| USING 115 KV GRACO AIR SPRAY GUN | | | | |
|---|---|---|---|---|
| GUN VOLTAGE | PROTECTOR VOLTAGE | PROTECTOR TO GUN CL | WEIGHT GAIN (GRAINS) | % REDUCTION |
| −115 KV | Ground | 3" | 4.54 | — |
| −115 KV | −30 KV (Graco) | 3" | 2.24 | 51% |
| −115 KV | −40 KV (Graco) | 3" | 2.44 | 46% |
| −115 KV | −30 KV (Spellman) | 3" | 2.25 | 50.5% |
| −115 KV | Ground | 6" | 2.05 | — |
| −115 KV | −30 KV (Graco) | 6" | 0.92 | 55% |
| −115 KV | −30 KV (Graco) | 6" | 0.72 | 65% |
| −115 KV | −40 KV (Graco) | 6" | 0.54 | 74% |
| −115 KV | −50 KV (Graco) | 6" | 0.32 | 84% |
| −115 KV | −30 KV (Spellman) | 6" | 0.59 | 71.5% |
| −115 KV | −30 KV (Spellman) | 9" | *1.72 | 98%+ |
| −115 KV | Ground | | *84.94 | |
| −115 KV | Ground | | 3.11 | |
| −115 KV | −30 KV (Spellman) | | 0.18 | 94% |

*30 MINUTE TEST-PAINT DRIPPED FROM GROUNDED PANEL 50 WT. IS LESS THAN ACTUAL.

When the spray gun 11 is very close to the "Protector" panel 30, e.g., three inches, the velocity of the particles overcome the repelling force from the panel, and the paint reduction ranges from 46% to 51%. When the gun pattern centerline is at nine inches from the bottom edge of the protector panel, the reduction of paint accumulation ranged from 94% to 98%.

Experiment IV: Conveyor Protection Test

In this experiment the gun centerline was run at 0, 3, 6, 9 and 12 inches from the bottom of the plastic protector around the conveyor housing. Table IV shows the results:

TABLE IV

| GUN VOLTAGE | PROTECTOR VOLTAGE | PROTECTOR TO GUN CL | WEIGHT GAIN (GRAINS) | % REDUCTION |
|---|---|---|---|---|
| −60 | Ground | 0" | 3.42 | |
| −60 | −30 KV | 0" | 0.84 | 75.5% |
| −60 | Ground | 3" | 1.04 | — |
| −60 | −30 KV | 3" | 0.08 | 92% |
| −60 | Ground | 6" | 0.54 | — |
| −60 | −30 KV | 6" | 0.12 | 78% |
| −60 | Ground | 9" | 0.05 | |
| −60 | −30 KV | 9" | — | 100% |
| −60 | Ground | 12" | 0.05 | |
| −60 | −30 KV | 12" | — | 100% |

FIG. 4 depicts a graph having a curve 70 which shows how accumulation of stray paint varies according to the voltage on the panel 30 when the spray gun 11 is charged to −100,000 volts D.C. at a distance of at least ten inches from the target and no closer than 6 inches from the paint repelling panel. Curve 70 shows that the paint repelling panel minimizes accumulation of stray paint when it is charged to −30,000 volts D.C.

Those skilled in the art can calibrate the paint repelling panel with the appropriate amount of voltage necessary to repel electrically charged, oversprayed paint according to the mass, volume and charge of the paint droplets, the velocity of the paint droplets as they leave the spray gun, the voltage on the spray gun and the distance of the spray gun from the target and panel.

The foregoing shows that the invention achieves several objectives and attains other advantageous results.

Because one could change the above constructions in various ways without departing from the scope of the invention, the applicant herein intends that all matter contained in the above description or shown in the accompanying drawings shall be interpreted as illustrative and not in a limiting sense.

What is claimed is:

1. An apparatus for producing an electric field within a booth having a plurality of walls for repelling overspray from accumulating on said walls to reduce substantially the cleaning of the walls of the booth tending to accumulate paint thereon, comprising:

means for charging a paint spray gun to a first potential, said paint spray gun emitting charged paint particles;

means for charging a target to be painted to a second potential so that the electrically charged paint particles emitted by said spray gun have a first electrostatic force applied to them urging the electrically charged paint particles toward the target; and means for charging the booth walls tending to accumulate paint thereon to a third potential intermediate the first potential and the second potential to apply a second electrostatic force to the charged paint particles urging said charged paint particles away from said booth walls charged to said third potential;

said walls of the booth being formed of conductive sheets having a large surface area to carry an electric potential sufficient to repel the charged paint particles; and an insulating layer on the sheets facing the particles having a characteristic which does not prevent the sheet from repelling electrically charged paint particles, and a characteristic which aids in suppressing of arcing.

2. An apparatus in accordance with claim 1 wherein said means for charging the booth walls comprises a power supply;

said insulating layer covering the side edges and a rear side of the conductive sheets to prevent arcing.

3. An apparatus in accordance with claim 2 wherein said power supply comprises a variable potential power supply for charging the walls to a potential ranging from 0 volts to 65,000 volts D.C. negative.

4. An apparatus in accordance with claim 2 wherein said means for charging one of the walls of the booth further comprises means for transferring electric charge between said power supply and said walls.

5. In a paint spray booth having an electrostatic paint device for generating paint spray particles with a first polarity electric charge thereon, said booth being constructed to reduce substantially the cleaning of paint spray from the booth walls and to reduce substantially the accumulation of paint thereon, comprising:

a plurality of side panels and ceiling panels on the booth, means for supporting grounded articles to be painted which assume an opposite polarity to attract the first polarity charged paint particles thereto, some of the panels having a charge carrying plate thereon, an electrical means connected to the charge carrying plates of the panels to apply the first polarity charge to the plates to repel paint particles from coating their associated panels;

said electrical means providing a voltage having a magnitude of 60,000 to 135,000 volts D.C. to the electrostatic paint device to charge the paint particles;

said electrical means supplying a voltage having a magnitude of about 20,000 to 50,000 volts D.C. to side panels and ceiling panels, and means for supplying current at 10 to 50 microamperes to the panels.

6. A booth in accordance with claim 5 in which the electrical means comprises a transformer and supplies a voltage of about −30,000 volts D.C. or greater and a current of less than 5 milliamperes to the current carrying plates.

7. A method of electrostatic paint spraying in a booth having walls in a manner to reduce the accumulation of paint on the booth walls in order to reduce maintenance of the booth, said method comprising the steps of:

conveying an article to be painted through the booth inside a conveyor protection housing, electrically charging a paint applicator device to a first potential, providing panels on booth walls, conveyor housing and booth ceiling and insulating the edges of the panels to prevent arcing therebetween, electrically charging paint particles with the paint applicator device and directing the charged paint particles toward the article, electrically grounding the article, the potential difference between the first potential and the ground creating an electric field for attracting the paint particles to the article being conveyed, and electrically charging the panels of the walls of the booth and on the conveyor protection housing and on the ceiling to a third potential selected to maximize the deflection of paint particles and in the range substantially lower than the first potential and between the first potential and ground to create an electric field for deflecting paint particles from coating the wall conveyor protection housing, and ceiling thereby reducing paint accumulation on the wall conveyor protection housing, and ceiling and the maintenance thereof, and controlling the current to prevent incipient arcing with the highly-charged panels.

8. A method in accordance with claim 7 in which the charged wall in the booth covers a conveyor protection device.

9. A method of electrostatic paint spraying in a booth having walls in a manner to reduce the accumulation of paint on the booth walls in order to reduce maintenance of the booth, said method comprising the steps of:

conveying an article to be painted through the booth, electrically charging a paint applicator device to a first potential, electrically charging paint particles with the paint applicator device and directing the charged paint particles toward the article, electrically grounding the article, the potential difference between the first potential and the ground creating an electric field for attracting the paint particles to the article being conveyed, and electrically charging a wall in the booth to a third potential selected to maximize the deflection of paint particles and in the range between the first potential and ground to create an electric field for deflecting paint particles from coating the wall thereby reducing paint accumulation on the wall and the maintenance thereof, and providing a dielectric layer over the charged wall to prevent arcing and to provide an easier surface for cleaning.

10. A coating booth having an electrostatic coating device for producing coating particles electrically charged with a first negative DC potential in order to coat articles with said coating particles, said coating booth comprising:

a plurality of panel means forming at least some of internal surfaces within said coating booth, at least some of said panel means having a conductive means covered by a dielectric material;

grounding means for supporting and grounding said articles to be coated such that said coating particles are attracted to said articles; and electrical means coupled to said conductive means of said panel means to apply a panel potential to said panel means, said panel potential being between said ground potential and said first negative DC potential such that said coating particles tend to be repelled from said panel means.

11. A coating booth as set forth in claim 10 wherein said conductive means is a sheet of aluminum having a large surface area.

12. A coating booth as set forth in claim 10 wherein said dielectric material is a layer of polypropylene.

13. A coating booth as set forth in claim 10 wherein said dielectric material is a layer of plastic.

14. A coating booth as set forth in claim 10 wherein said dielectric material is a layer of glass.

15. A coating booth as set forth in claim 10 wherein said conductive means is a sheet of metal.

16. A coating booth as set forth in claim 10 wherein said conductive means is metal mesh.

17. A coating booth as set forth in claim 10 wherein said dielectric material encapsulates said conductive means.

18. A coating booth as set forth in claim 10 wherein said dielectric material extends beyond the edges of said conductive means.

19. A coating booth as set forth in claim 10 wherein each of said panel means is at least one foot by one foot.

20. A coating booth as set forth in claim 10 including conveyor means for conveying said articles within said coating booth, at least some said plurality of said panel means forming a conveyor protective housing for said conveyor means.

21. A spray paint booth apparatus for electrostatically painting a target with paint particles emitted from a paint spraying means, said spray paint booth apparatus comprising:

paint spray charging means for charging said paint spraying means to a first direct current potential that is negative with respect to ground potential such that said paint particles emitted from said paint spraying means have a first negative DC potential with respect to ground;

target conveying means for conveying said target in said spray paint booth apparatus and coupling said target to ground potential so that the electrically charged paint particles emitted by said paint spraying means are attracted toward said target;

a plurality of wall means at least partially forming internal surfaces within said spray paint booth apparatus, said wall means being disposed in spatial relationship with respect to said target, at least some of said wall means including conductive means covered by a dielectric shield; and wall charging means for charging said at least some of said wall means to a second negative DC potential of approximately 30,000 volts DC negative with respect to ground, said second negative DC potential being intermediate said first negative DC potential and said ground potential such that said paint particles tend to be repelled from said at least some of said wall means charged to said second negative DC potential.

22. A method of electrostatically paint spraying articles in an enclosure having walls, at least some of said walls of said enclosure include a conductive means covered by a dielectric shield, said method comprising the steps of:

conveying at least one article to be painted into said enclosure;

electrically charging a paint applicator device to a first higher negative potential than a negative 30,000 volts DC so as to produce electrically charged paint particles that are directed toward said article, said charged paint particles being charged to said first potential;

electrically grounding said article to be painted, the potential difference between said first potential on said charged paint particles and said grounded article creating an electric field so that said paint particles are attracted to said article being conveyed through said enclosure; and electrically charging said at least some of said walls in the enclosure to a potential of approximately negative 30,000 volts DC with respect to ground so that the resulting electric field created by said wall deflects paint particles from said wall.

* * * * *